US009378715B2

(12) United States Patent
Nigro

(10) Patent No.: US 9,378,715 B2
(45) Date of Patent: Jun. 28, 2016

(54) PERCUSSION MUSICAL INSTRUMENT

(71) Applicant: Luciano Nigro, Catania (IT)

(72) Inventor: Luciano Nigro, Catania (IT)

( * ) Notice: Subject to any disclaimer, the term of this patent is extended or adjusted under 35 U.S.C. 154(b) by 0 days.

(21) Appl. No.: 14/729,938

(22) Filed: Jun. 3, 2015

(65) Prior Publication Data

US 2015/0348521 A1 Dec. 3, 2015

(30) Foreign Application Priority Data

Jun. 3, 2014 (IT) ..... PA2014A0007

(51) Int. Cl.
*G10D 13/02* (2006.01)

(52) U.S. Cl.
CPC ..... *G10D 13/026* (2013.01); *G10D 13/028* (2013.01)

(58) Field of Classification Search
CPC .... G10D 13/026; G10D 13/028; G10D 13/02
See application file for complete search history.

(56) References Cited

U.S. PATENT DOCUMENTS 2,386,311 A 10/1945 Hanrahan
4,869,146 A * 9/1989 Bonsor ..... G10D 13/02 84/411 R
5,349,891 A 9/1994 Belli
5,353,674 A * 10/1994 Volpp ..... G10D 13/02 84/411 R
5,447,087 A * 9/1995 Hawes ..... G10D 13/02 84/413
5,606,142 A * 2/1997 Volpp ..... G10D 13/02 84/411 R
6,580,023 B2 * 6/2003 Belli ..... G10D 13/027 84/411 R
8,686,264 B2 * 4/2014 Morita ..... G10D 13/02 84/413
2001/0049993 A1 * 12/2001 Hagiwara ..... G10D 13/028 84/411 R
2003/0029301 A1 * 2/2003 Belli ..... G10D 13/027 84/411 R
2014/0053707 A1 * 2/2014 Belli ..... G10D 13/02 84/411 R
2015/0348521 A1 * 12/2015 Nigro ..... G10D 13/028 84/421

FOREIGN PATENT DOCUMENTS

WO 2005038770 A2 4/2005

* cited by examiner

*Primary Examiner* — Robert W Horn
(74) *Attorney, Agent, or Firm* — Andrey Shostak

(57) ABSTRACT

A percussion musical instrument comprises an hollow sound box defining a central longitudinal axis with an open upper end portion having a first annular edge, a membrane defining a striking surface fastened to the first annular edge for closing the same, anchoring means for the stretched anchoring of the membrane to the upper end portion of the sound box comprising watertight means adapted to avoid liquid leakage through the first annular edge for allowing the instrument to be used also with the membrane in upside down position and with liquid inside the sound box and into contact with the membrane.

17 Claims, 5 Drawing Sheets

PERCUSSION MUSICAL INSTRUMENT

CROSS-REFERENCE TO RELATED PATENT APPLICATIONS

This application claims priority from Italian Application PA2014A000007, filed Jun. 3, 2014, titled "STRUMENTO MUSICALE A PERCUSSIONE," which is incorporated herein by reference in its entirety.

BACKGROUND

1. Field

The present invention finds its application in the technical field of the musical instruments and particularly relates to a percussion musical instrument.

2. Brief Description

As is known, the percussion musical instruments are essentially constituted by a hollow body defining the resonance chamber and having an upper opening closed by a suitably stretched membrane, made of leather or other natural or synthetic fiber, forming the striking surface.

An example of a percussion instrument is the darbuka, formed by a sound box having the form of a double opposing cones with a narrowing middle portion and an enlarged upper opening which the percussion membrane is fixed to.

The sound box may be made of natural materials, for example wood or clay as for the traditional instruments, or metals and metal alloys, for example aluminum and its alloys, in the case of modern instruments.

To allow the fixing of the membrane, the upper edge of the sound box is step-shaped so as to define a seat for housing a locking ring to be screwed to the sound box.

The anchoring of the ring to the sound box is provided by means of a plurality of through screws that pass through-holes made both at the outer ring and at the inner circular edge of the sound box.

It is also known in popular music culture to use water inside musical instruments in order to obtain a modification of the sound depending on the quantity of water and of the movement thereof inside the instrument.

These instruments, an example of which is the udu, are generally constituted by vessels or other containers in a material suitable for contact with water, for example earthenware, clay or other ceramic materials, designed to be stuck directly on the walls and that have no striking membranes of leather or other elastic material.

On the contrary, the known percussion instruments with membrane made of leather or other material, even synthetic, defining the striking surface, do not allow the use with water or other liquids thereinto, in order to modulate the sound by varying the level of liquid, as the own elasticity of the percussion surface necessarily would cause leakage as a result of vibrations.

For example, in the case of the darbouka described above, usually played with the striking surface facing down, the water would be in contact with the fixing screws of the ring, leaking through the threads.

Moreover, the materials typically used for the sound box are not suitable for contact with water and liquids in general and with time would deteriorate.

A further drawback of the known instruments is represented by the fact that their sound boxes are formed by several parts assembled together, so that in correspondence of the junction lines there are discontinuity lines that cause sound distortion.

U.S. Pat. No. 2,386,211 discloses a closure for metal drums which requires the application of a ring folded in such a way as to have a tight seal of the edge. The drum has a metallic percussion surface applied to the sound box in a fixed manner by welding. Such a system is not suitable to drums provided with flexible striking surface, i.e. in natural or synthetic leather, as it damages the same and would also not allow the correct tensioning.

However, besides this drum does not have a membrane but a metal surface, the type of tight sealing (which requires the welding of the folded edges) is not adapted to be applied to drums with membrane.

SUMMARY

The object of the present invention is to overcome the above drawbacks, providing a percussion musical instrument which can be effectively used also in the presence of water or other liquid thereinside to obtain tones and sounds different than normal use of the instrument.

A particular object is to provide a percussion musical instrument adapted to be used with water or other liquid thereinside without liquid losses and leakages through the striking surface.

A further object is to provide a percussion musical instrument adapted to be used with water or other liquid thereinside and which is resistant to such use, even continued, while ensuring high mechanical and structural resistance.

Still another object is to provide a percussion musical instrument adapted to be used with water or other liquid thereinside and in which the level and/or the local inclination of the liquid can be easily adjusted and controlled to make easy the sound modulation.

Still another object is to provide a percussion musical instrument that has high quality and sound conduction.

Not least object of the present invention is to provide a percussion musical instrument that can be realized in a fast and economical way by molding.

These objects, and others which will appear more clearly hereinafter, are achieved by a percussion musical instrument that, according to claim 1, comprises a hollow sound box defining a central longitudinal axis with a open upper end portion having a first annular edge, a striking surface fastened to said first annular edge for closing thereof, means for anchoring said striking surface to said upper end of said sound box, watertight means adapted to prevent the leakage of liquids through said first annular edge to allow the use of the instrument even in the upside down position and in the presence of liquid in said sound box and in contact with said striking surface.

The striking surface comprises a flexible membrane, said anchoring means being adapted to tension said flexible membrane and to allow its removably anchoring to said sound box.

In the present text, the terms upper and lower are used only for purposes of clarity and should be understood with the instrument resting in correspondence of the end opposite to that provided with the membrane, which will not necessarily correspond to the position of use.

Thanks to this combination of features it will be possible to use the instrument also with the membrane in upside down position and in the presence of liquid in the sound box and in contact with the membrane itself In addition, it will be possible to obtain always the correct tensioning of the striking surface and possibly replace it.

The type of liquid used inside of the sound box does not represent a limitation for the scope of protection of the present invention because any type of liquid may be supplied inside the sound box, not necessarily water.

Suitably, the sound box may comprise a frusto-conical annular portion surrounding said upper end portion and provided with said watertight means and with a second annular edge defining a support plane substantially orthogonal to said longitudinal axis.

Suitably, the anchoring means may comprise a fixing annular ring arranged peripherally to the first annular edge and adapted to be removably anchored to the sound box by the watertight means.

Moreover, the watertight means may comprise a series of through holes angularly offset with each other and formed in said annular ring and a series of blind holes formed in said frusto-conical annular portion and alignable with corresponding through holes to allow the insertion of respective fastening members such as screws, pins or the like.

In this way the fastening members will not be exposed to contact with the liquid into the sound box, avoiding that there may be leakage of liquid through the housing seats of the fastening members and possible threads thereof.

Advantageously, each of said fastening members may comprise a threaded screw inserted into a corresponding plug and having a thread reverse with respect to the thread of the corresponding plug.

In this way, the screwing of the screw will cause the consequent tightening of the plug within the respective holes, further improving the tightness to liquids.

Preferably, the upper end of said sound box may be substantially cylindrical and said frusto-conical annular portion will be formed in one piece with said sound box.

This particular configuration allows to have a sound box in a single piece and without the typical discontinuities lines due to the need to join together pieces made at different times, thus ensuring high quality and sound conduction.

Preferably, said sound box may be realized in a polymeric material at least partially optically transparent or translucent, such as PPMA or the like, to allow viewing inside it and to permit adjustment of the liquid level and its local variation due to different inclinations of the instrument in order to change the sound.

The use of such materials will have the additional advantage of ensuring high resistance to water as well as an optimal mechanical resistance.

In addition or alternatively, said sound box may comprise means for local indicating the level of liquid thereinside and/or to indicating the inclination of the sound box.

Advantageously, said sound box will be open at both ends with a peripheral wall having a substantially constant thickness with a substantially cylindrical upper end portion joined to a frusto-conical intermediate portion converging towards said central axis and in turn joined with a diverging frusto-conical longitudinal portion open at the lower end.

In this way the instrument may be realized by a single operation of injection molding or the like, being relatively cheap and particularly efficient from the point of view of the produced sound.

Suitably, said first annular edge may be substantially flat with a minimum transverse width next to 5 mm and optionally provided with a groove which houses an annular seal.

In this way it will possible to eliminate the presence of sharp edges in contact with the membrane that may damage the same or favor passages of liquid upon the elastic return of the membrane due to the vibrations caused by the user.

Advantageous forms of the invention are obtained according to the dependent claims.

BRIEF DESCRIPTION OF THE DRAWINGS

Further features and advantages of the invention will become more apparent in light of the detailed description of a preferred but not exclusive embodiment of a percussion musical instrument according to the invention, illustrated by way of non-limiting example with the aid of the accompanying drawing, in which.

DETAILED DESCRIPTION

With reference to the accompanying figures there is shown a percussion musical instrument according to the invention that in the shown embodiment is a darbuka.

It is however understood that the instrument according to the invention may also be a different type of percussion instrument falling under the category of drums, such as djembe, bongo, conga and the like.

Figure 1:
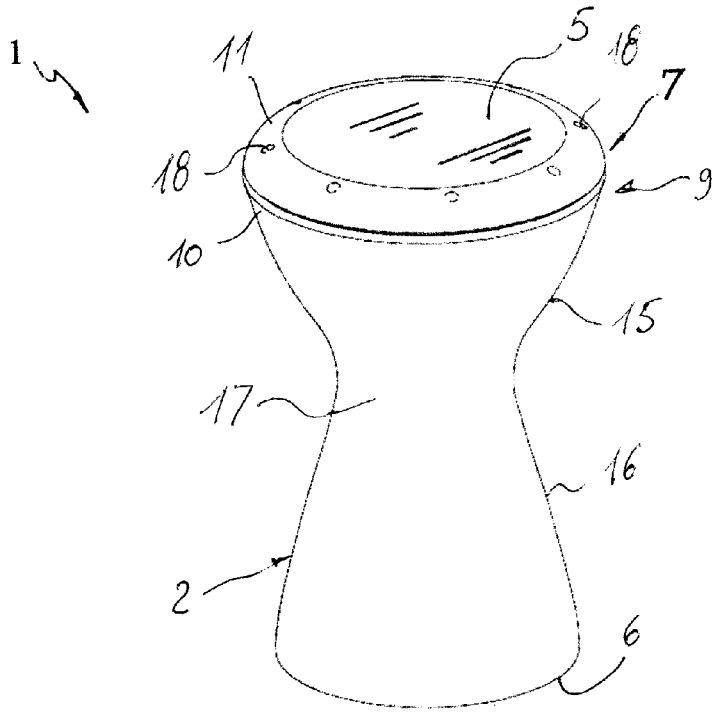
FIG. 1 is a perspective view of an instrument according to the invention.
Figure 2:
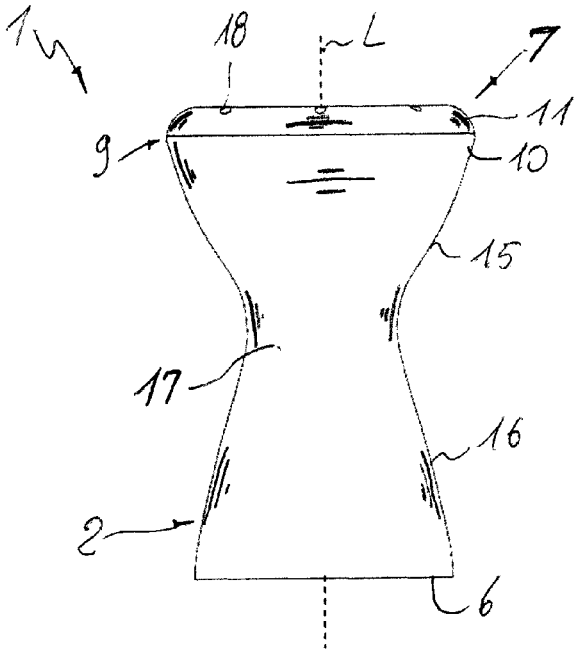
FIG. 2 is a front view of the instrument of FIG. 1.
Figure 3:
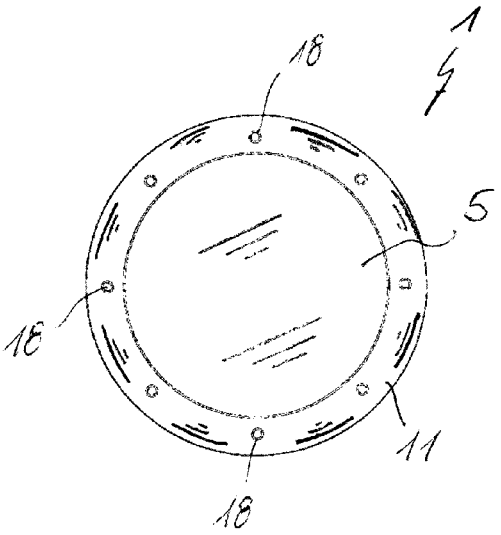
FIG. 3 is an upper view of the instrument of FIG. 1.

As visible from FIGS. 1 to 3, in its most general embodiment the musical instrument, generally indicated by 1, comprises an internally hollow sound box 2 defining a longitudinal central axis L and having an upper end portion 3 provided with a membrane 5 defining the striking surface.

Figure 4:
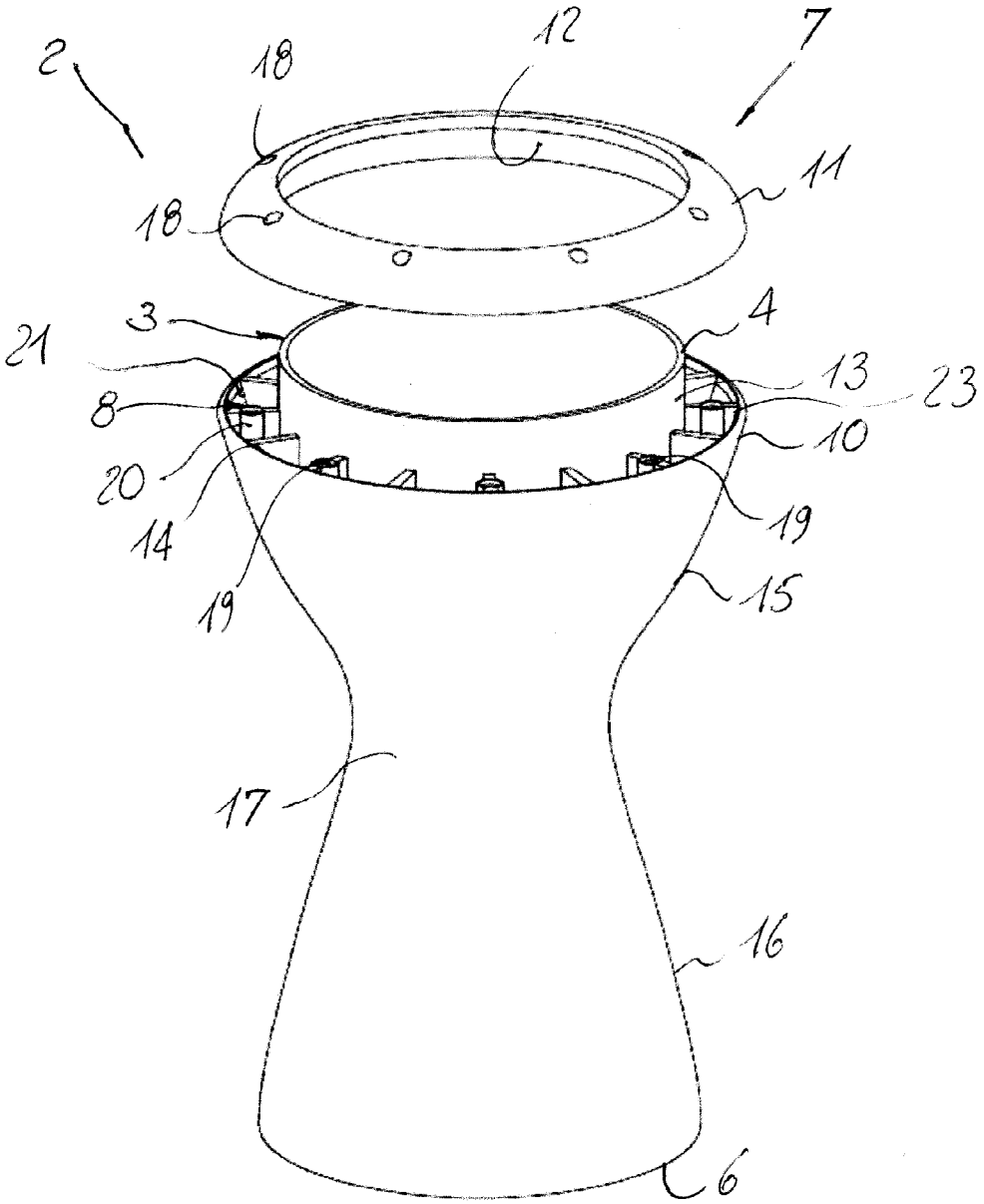
FIG. 4 is an exploded perspective view of the instrument of FIG. 1.

From FIG. 4 it could be observed that the sound box 2 is open at its upper end portion 3 in correspondence of which it has a first annular edge 4 which the membrane 5 is fastened to, so as to close the upper opening.

Figure 5:
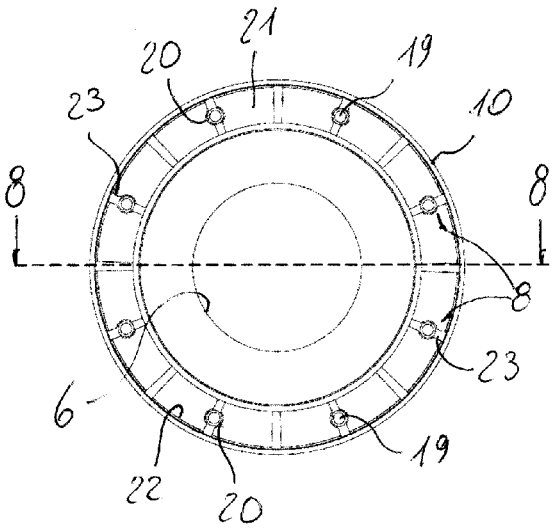
FIG. 5 is an exploded front view of the instrument of FIG. 1.

In the illustrated configuration the sound box 2 will also be open at the lower end 6, as visible in particular from FIG. 5.

Means 7 are also provided for the tensioned anchoring of the membrane 5 to the upper end portion 3 of the sound box 2, which means also including watertight means 8 adapted to prevent the leakage of liquids through the first annular edge 4.

Figure 6:
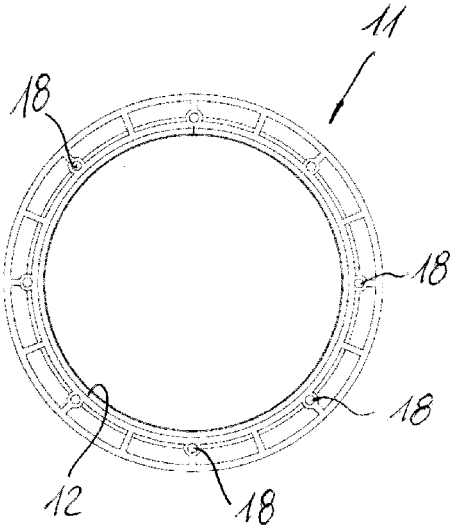
FIG. 6 is an upper view of the instrument of FIG. 1 without the removable annular portion and the membrane.

The anchoring means 7 comprise a fixing annular ring 9 arranged peripherally to the first annular edge 4 and having a frusto-conical annular portion 10 fixed on the sound box 2 and that surrounds the upper end portion 3 and a removable annular portion 11 adapted to be anchored to the fixed portion 10 by means of the watertight means 8 and illustrated according to a view from below in FIG. 6.

The consequent blocking of the membrane 5 may be obtained upon the interposition of its outer edge between the fixed annular portion 10 and the removable one 11 or between the inner peripheral wall 12 of the removable annular portion 11 and the outer cylindrical surface 13 of the upper end portion 3 sound box 2.

Figure 7:
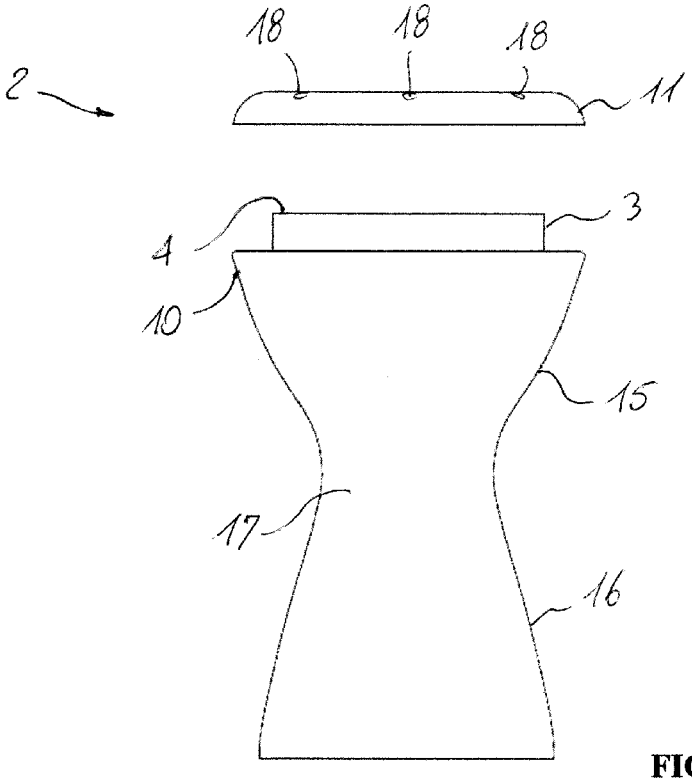
FIG. 7 is a view from below of the instrument of the removable annular portion.
Figure 8:
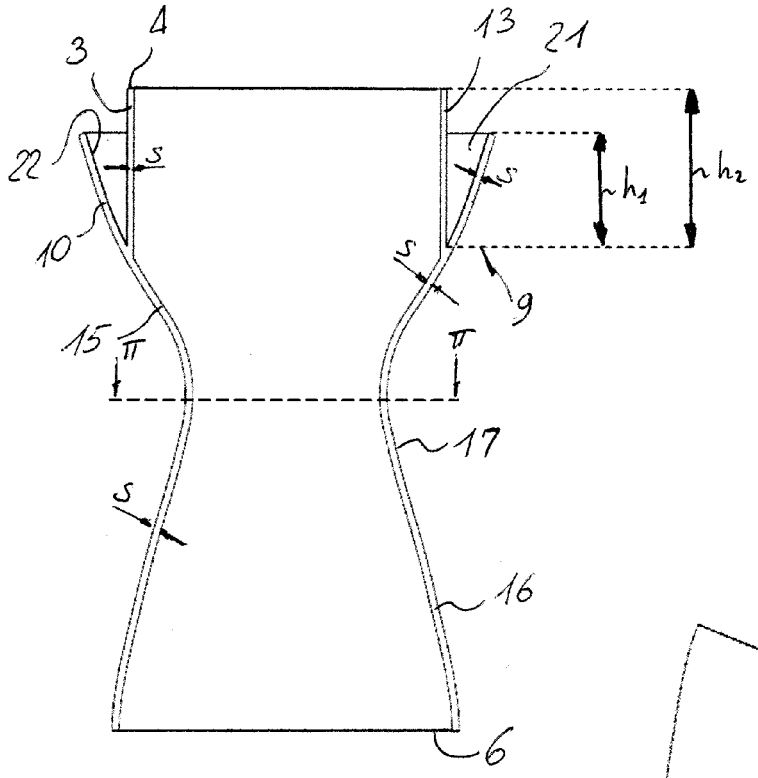
FIG. 8 is a cross sectional front view of the detail of FIG. 5 according to the 8-8 plane.

As matter of fact, as visible from FIG. 7, and even more clearly from the section of the FIG. 8, the sound box 2 has an upper end portion 3 substantially cylindrical which the fixed annular portion 10 of the fixing annular ring 9 is fixed to, having in turn a substantially frusto-conical shape diverging towards the upper end portion 3.

The fixed annular portion 10 is formed in one piece with the sound box 3 with height h1 lower than the height h2 of the upper end portion 3 to define a second annular edge 14 and a supporting plane orthogonal to the longitudinal axis L for positioning the removable portion 11.

The upper end portion 3 is substantially cylindrical and is also joined to a frusto-conical intermediate portion 15 converging towards the central axis L and which represents the extension of the fixed annular portion 10 toward a middle transverse plane π of the sound box 2 in correspondence of which it has a narrowing of the cross section.

The intermediate portion 15 is in turn connected to a lower end portion 16 which is also frusto-conical, diverging and open at one end 6, so as to define a sound box 2 having an outer peripheral wall 17 with the typical configuration with mutually opposite cones.

As always visible from FIG. 8, the different portions 3, 15, 16 of the peripheral wall 17 of the sound box 2 will have a substantially constant thickness s equal to each other. In this way, in the case where the sound box 2 is obtained by molding, for example injection molding as described below, the injected material will cool down in a uniform manner avoiding the occurrence of cracks or other structural weakening.

The watertight means 8 comprise a series of through holes 18 angularly offset from each other made in the removable annular portion 11 and a series of blind holes 19 made in the fixed annular portion 10 and alignable with corresponding through holes 18 to allow insertion of the respective fixing members such as screws, pins or similar, not shown.

As visible from FIG. 4, the blind holes 19 may be formed in corresponding substantially longitudinal cylindrical bodies 20 housed in a fixed manner into the annular interspace 21 comprised between the inner peripheral surface 22 of the fixed annular portion 10 and the outer peripheral surface 13 of the cylindrical portion 3 and fixed thereto by means of respective pairs of fins 23.

The blind holes 19 are internally threaded and each of the fixing members comprise a threaded screw inserted into a corresponding plug designed to be inserted in one of the blind holes 19 and having a reverse thread with respect to the thread of the corresponding plug.

To improve the sealing, the first annular edge 4 will be substantially flat with a minimum transverse width close to 5 mm, in order to reduce the shear stress on the membrane 5 and promote adhesion to the edge 4 itself even upon its vibration produced by percussion.

According to an alternative variant, not shown in the figures, the first flat upper edge 4 will be provided with a groove inside which may house an annular seal further improving the liquid-tight seal.

The membrane 5 may be either made of natural or synthetic leather or also in natural, artificial or synthetic fabric, without particular limitations, as long as resistant to the used liquid and substantially impermeable thereto.

The sound box 2 will be preferably made of a polymeric material at least partially optically transparent or translucent, such as PPMA or similar, to allow viewing thereinside.

Figure 9:
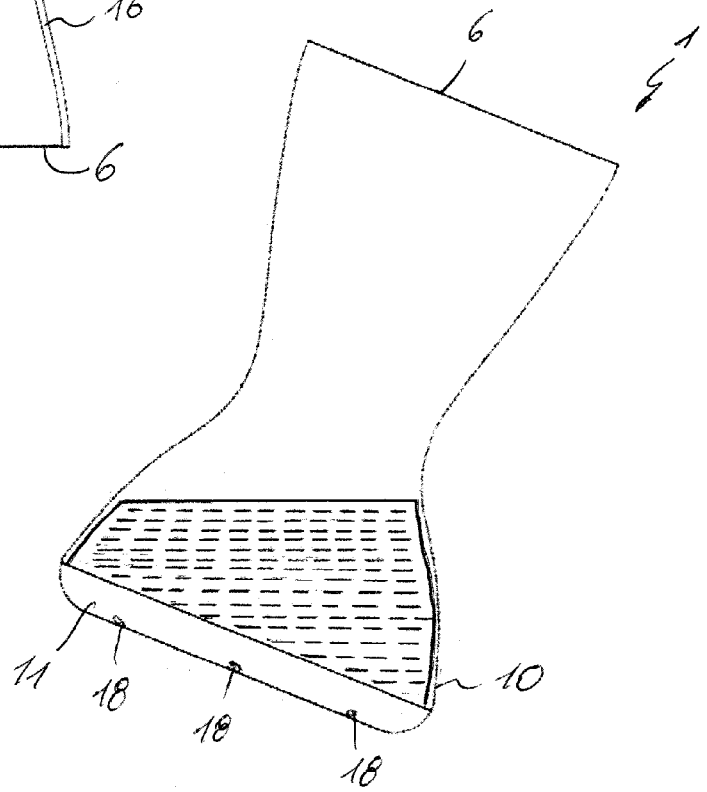
FIG. 9 is a perspective view of the instrument of FIG. 1 in a particular condition of use and with a liquid thereinside.

In this way, as exemplified in FIG. 9, the user may easily adjust the relative inclination between the membrane 5 and the free surface of the liquid so as to vary the local level and have portions of the membrane 5 in contact with higher liquid columns and other in contact with shorter liquid columns to produce different sounds depending on the movement of the liquid and its position inside the sound box 2.

In particular, it can possible to modify both the main note and the range of emitted frequencies, allowing to achieve a similar effect to the so-called wah-wah effect of the electric instruments, in particular of the electric guitars.

According to a not shown variant, the sound box 2 may comprise means for indicating the inclination and/or the local level of liquid present thereinside.

For example, the sound box may not be transparent and have on its outer peripheral wall 17 one or more indicators such as a bubble level or the like arranged at different heights and with different inclinations with respect to the longitudinal axis L so that the user can get information about the inclination of the instrument 1 through the reading of the same indicators.

Moreover, suitably offset transparent windows may be provided to allow the reading of the liquid level and the verification of the inclination, or a single rotatable indicator may be provided on the peripheral wall 17 associated with a fixed graduated scale indicating the inclination.

Figure 10:
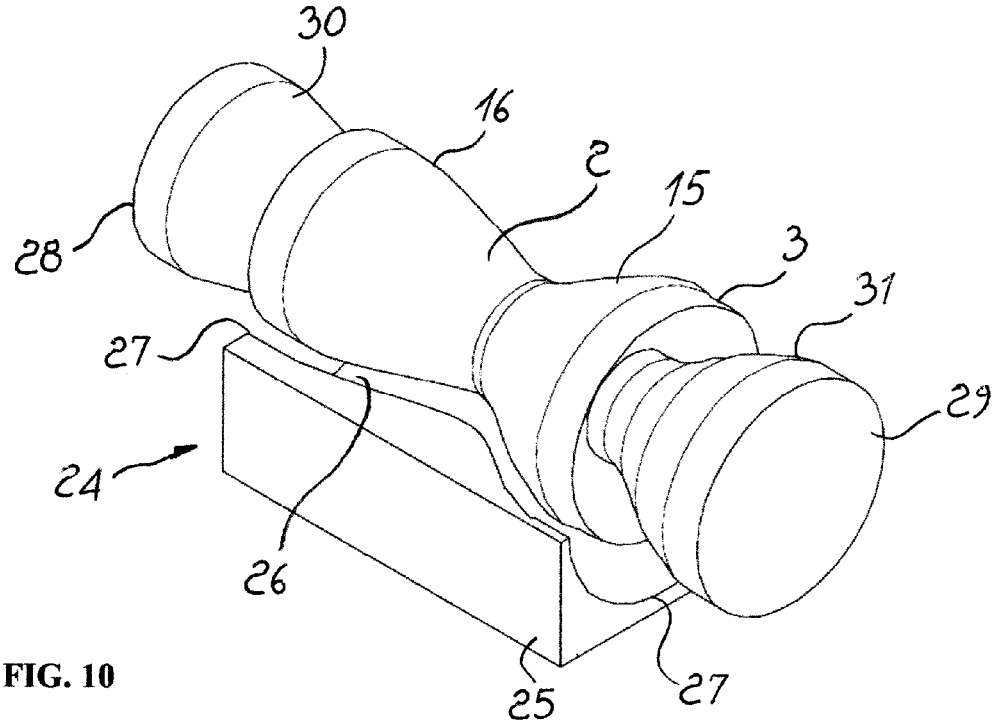
FIG. 10 is a partial perspective view of a mould for manufacturing the instrument according to the invention.

Finally, FIG. 10 shows the sound box 2 inserted within an injection mold 24 with which it will be possible to realize it as a unitary body, thanks to its particular double cone shape with a cylindrical end portion 3.

The mold 24 essentially comprise an external formwork composed by a pair of half-shells, one of which is illustrated in the figure and indicated with 25, suitably hollowed thereinside to define, when closed, an internal cavity 26 complementary in shape to the outer peripheral wall 17 of the sound box 2.

The formwork has two lateral openings 27 for the insertion of two male elements 28, 29 of substantially frusto-conical shape that will define, with the inner wall of the cavity 26, the overall shape of the sound box 2.

In known manner, the formwork will be also provided with the necessary melt channels and channels vent, not illustrated as of the known type.

The male element 28, designed to form the lower conical end portion 16, will be a full body with a continuous outer surface 30. The other male element 29 will be suitably grooved and provided with an annular cylindrical interspace 31 to allow the formation of the cylindrical end portion 3 and of the cylindrical bodies 20 designed to fit the screws.

Figure 11:
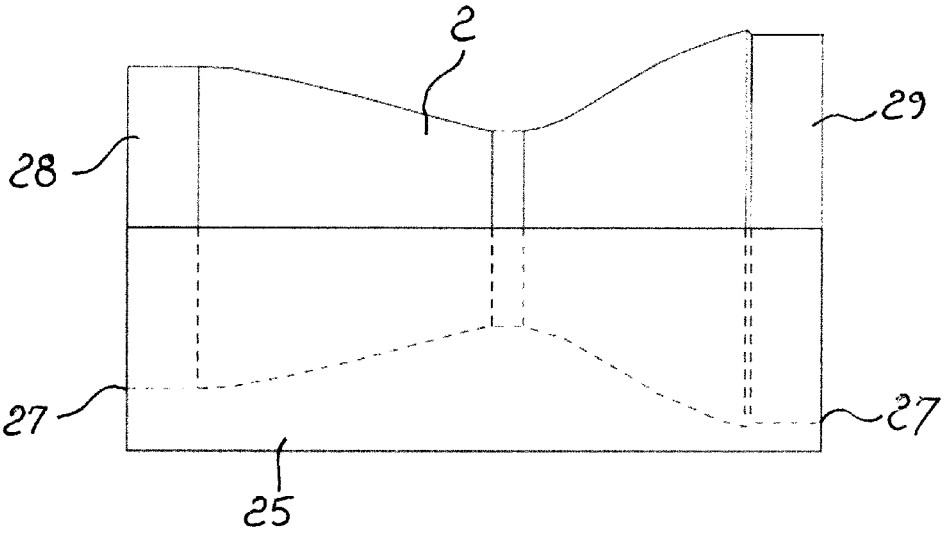
FIG. 11 is a front view of a portion of the mould FIG. 9 in a working condition.

As can be seen from FIG. 11, due to the particular configuration of the sound box 2 described above, different from the sound boxes of known instruments providing by contrast an upper opening narrower than the middle shrinking, it can be possible to extract the two male elements 28, 29 subsequently to the injection of the material inside the mold to manufacture the sound box through a single injection step and as one piece, apart of the removable annular portion 11.

It is also clear that such a manufacturing process by injection molding may be used advantageously also for musical instruments, such darbukas or the like, in any non-transparent polymeric or metallic material or for instruments lacking the aforesaid watertight means 8 but in which the fastening of the removable annular portion 11 is obtained in a conventional manner, for example with screws passing through both the removable ring 11 and the cylindrical surface 13 to come out inside of the sound box 2.

From above it appears evident that the instrument according to the invention reaches the intended objects.

The instrument according to the invention is susceptible of numerous modifications and variations, all falling within the inventive concept expressed in the accompanying claims. All the details may be replaced with other technically equivalent elements, and the materials may be different according to requirements, without departing from the scope of the present invention.

What is claimed is:

1. A percussion musical instrument comprising:

a hollow sound box having a central longitudinal axis and an open upper end portion, the upper end portion having a first annular edge;

a membrane defining a striking surface, the membrane anchored around the first annular edge for closing the open upper end portion; and an anchoring mechanism for the stretched anchoring of the membrane to the upper end portion of the sound box, wherein the anchoring mechanism comprises a fixing annular crown placed peripherally to the first annular edge and having a fixed annular portion fixed on the sound box and a removable annular portion anchored to the fixed annular portion through a connecting mechanism adapted to avoid liquid leakage through the first annular edge, wherein the connecting mechanism comprises through-holes formed in the removable annular portion and blind holes formed in the fixed annular portion and alignable with the corresponding through-holes to allow the insertion of corresponding fixing elements.

2. The instrument of claim 1, wherein the through-holes and the blind holes are substantially equally angularly offset from each other around the central longitudinal axis and at a substantially same distance from the central longitudinal axis, the through-holes and the blind holes being on a plane substantially perpendicular to the central longitudinal axis.

3. The instrument of claim 1, wherein the through-holes are internally threaded.

4. The instrument of claim 2, wherein the fixing elements comprise a threaded screw removably inserted into a corresponding plug, the corresponding plug inserted in a respective blind hole and having a threading opposite to that of the corresponding threaded screw.

5. The instrument of claim 1, wherein the upper end portion of the sound box is cylindrical, the fixed annular portion of the annular crown being frusto-conical and made of one piece with the sound box.

6. The instrument of claim 5, wherein the fixed annular portion has a height lower than the height of the upper end portion to define a second annular edge for positioning the removable annular portion.

7. The instrument of claim 1, wherein the sound box is made of a polymeric material at least partially optically transparent or translucent to allow the view of its inside.

8. The instrument of claim 1, wherein the sound box further comprises, a peripheral wall having a constant thickness, an open lower end portion, and an intermediate frusto-conical portion joined with the upper end portion and converging toward a central axis, wherein the upper end portion is cylindrical.

9. The instrument of claim 8, wherein the lower end portion is frusto-conical and diverging from the central axis, the intermediate frusto-conical portion being joined with the lower end portion.

10. The instrument of claim 1, wherein the sound box is a one piece body made by injection molding.

11. The instrument of claim 1, wherein the first annular edge is flat and has a minimum transverse width of 5 mm, the first annular edge comprising a slot to house an annular sealing.

12. The instrument of claim 1, wherein the sound box comprises an indicator for indicating the inclination of or the liquid level inside the sound box.

13. The instrument of claim 12, wherein the indicator is a transparent window.

14. The instrument of claim 12, wherein the indicator is a rotatable indicator.

15. The instrument of claim 1, wherein the membrane is made of synthetic fabric.

16. A percussion musical instrument comprising:

a hollow one piece sound box made by injection molding and having a peripheral wall of a constant thickness, a central longitudinal axis, a cylindrical open upper end portion having a first annular edge, a frusto-conical open lower end portion, an intermediate frusto-conical portion joined with the upper end portion and converging toward a central axis, the lower end portion joined with the intermediate frusto-conical portion and diverging from the central axis;

a membrane defining a striking surface, the membrane anchored around the first annular edge for closing the open upper end portion; and an anchoring mechanism for the stretched anchoring of the membrane to the upper end portion of the sound box, wherein the anchoring mechanism comprises a fixing annular crown placed peripherally to the first annular edge and having a fixed annular portion fixed on the sound box and a removable annular portion anchored to the fixed annular portion through a connecting mechanism adapted to avoid liquid leakage through the first annular edge, wherein the connecting mechanism comprises through-holes formed in the removable annular portion and blind holes formed in the fixed annular portion and alignable with the corresponding through-holes to allow the insertion of corresponding fixing elements, wherein the through-holes and the blind holes are substantially equally angularly offset from each other around the central longitudinal axis and at a substantially same distance from the central longitudinal axis, the through-holes and the blind holes being on a plane substantially perpendicular to the central longitudinal axis.

17. A percussion musical instrument comprising:

a hollow sound box means for creating sound, the sound box means having a central longitudinal axis and an open upper end portion, the upper end portion having a first annular edge;

a membrane means for closing the open upper end portion, the membrane means defining a striking surface and anchored around the first annular edge; and an anchoring means for the stretched anchoring of the membrane means to the upper end portion of the sound box means, wherein the anchoring means comprises a fixing annular crown placed peripherally to the first annular edge and having a fixed annular portion fixed on the sound box means and a removable annular portion anchored to the fixed annular portion through a connecting mechanism adapted to avoid liquid leakage through the first annular edge, wherein the connecting mechanism comprises through-holes formed in the removable annular portion and blind holes formed in the fixed annular portion and alignable with the corresponding through-holes to allow the insertion of corresponding fixing elements.

* * * * *